United States Patent [19]

Kwiatkowski

[11] 4,067,034

[45] Jan. 3, 1978

[54] PHOTOGRAPHIC DEVELOPING MACHINE

[75] Inventor: Wolfgang Kwiatkowski, Unterhaching, Germany

[73] Assignee: AGFA-Gevaert, AG, Leverkusen, Germany

[21] Appl. No.: 728,832

[22] Filed: Oct. 1, 1976

[30] Foreign Application Priority Data

Oct. 3, 1975 Germany ..... 2544322

[51] Int. Cl.[2] ..... G03D 13/06

[52] U.S. Cl. ..... 354/310; 354/307; 354/319

[58] Field of Search ..... 354/307, 310, 313, 316, 354/319, 320, 321, 322

[56] References Cited

U.S. PATENT DOCUMENTS

| | | | |
|---|---|---|---|
| 3,195,438 | 7/1965 | Woodcock | 354/310 |
| 3,568,587 | 3/1971 | Laval | 354/310 |
| 3,810,568 | 5/1974 | Kwiaikowski | 354/310 |

FOREIGN PATENT DOCUMENTS

| | | | |
|---|---|---|---|
| 1,190,338 | 4/1965 | Germany | 354/319 |

*Primary Examiner*—L. T. Hix
*Assistant Examiner*—Alan Mathews
*Attorney, Agent, or Firm*—Michael J. Striker

[57] ABSTRACT

A processing machine includes a plurality of processing stations. An endless pull strip extends through the successive stations. A light lock compartment is located in the path of pull strip travel and has an open side opening into the interior of the processing machine. A flap structure moves between a closed position closing off the opening in the light lock compartment and an opened position. A holding socket on the machine holds a light-tight cassette containing photographic strip material to be processed. The socket has an infeed passage extending into the interior of the machine. The light lock compartment includes a movable cover. When the leading end of a strip is inserted into the infeed passage, the cover is opened, to afford access to the interior of the light lock compartment, so as to be able to attach the leading end to the pull strip. Opening of the cover causes the flap structure to close. The flap structure is so positioned relative to the infeed passage that when it closes it displaces the leading end of the inserted strip into the interior of the light lock compartment.

10 Claims, 8 Drawing Figures

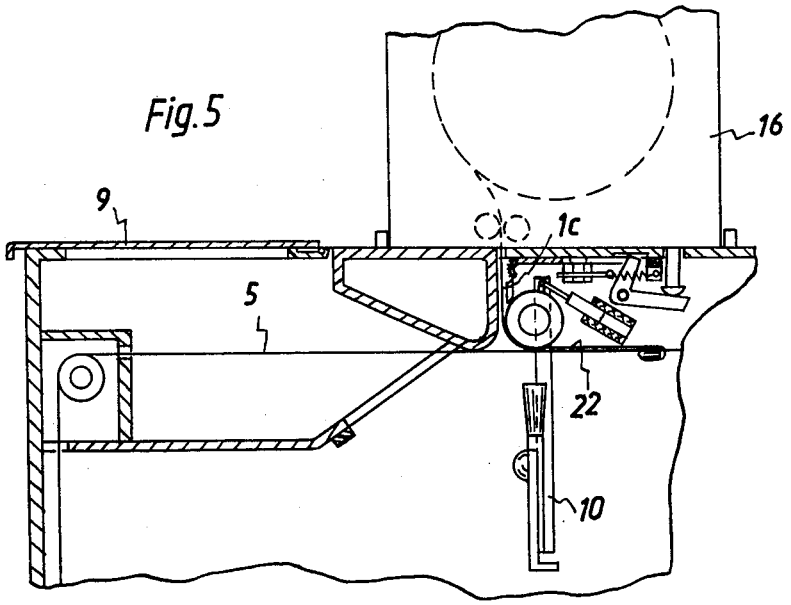
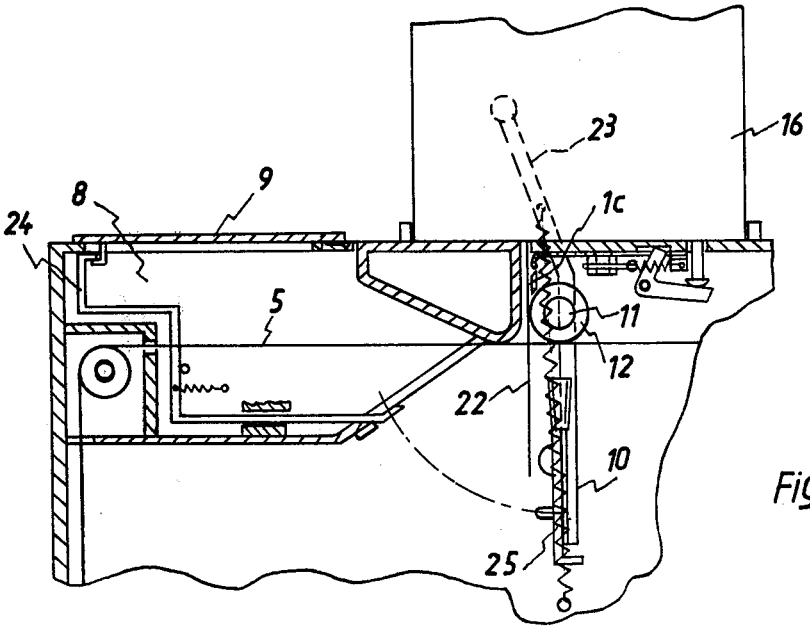
Fig.8

PHOTOGRAPHIC DEVELOPING MACHINE

BACKGROUND OF THE INVENTION

The invention relates to a photographic developing apparatus for the treatment of strips of photographic material. The photographic developing apparatus is of the type which incorporates an endless pull strip which travels through the various treatment stations of the developing apparatus and then returns back into the pull strip infeed location. The leading end of a strip of photographic material to be processed can be secured to the endless pull strip by means of clips. The photographic developing apparatus furthermore includes a light lock compartment which is light-tightly separated off from the interior of the developing apparatus proper. The light lock compartment is provided for the clipping on of the leading ends of strips to be processed. The photographic developing apparatus also includes an infeed passage which extends out from a holding socket for light-tight cassettes. The infeed passage leads into the interior of the developing apparatus proper at a location down-path of the light lock compartment, as considered in the direction of travel of the endless pull strip.

Federal Republic of Germany Pat. No. 1,190,338 discloses a photographic developing apparatus of the general type in question. In that apparatus, the infeed passage of the cassette holding socket closely adjoins the return path of the endless pull strip from the outside, oriented in direction opposite to the travel of the pull strip along its return path, and extending to an entrance slit for the back-travelling pull strip, the pull strip outside of this entrance slit being accessible for the clipping on of the the leading end of a photographic strip to be processed.

To block off the portion of the apparatus located down-path of the entrance slit for the pull strip, it is necessary to provide the path for the pull strip and the infeed passage down-path of the pull strip entrance slit with bends. These bends are a constant source of trouble when feeding the leading ends of photographic strips into the apparatus. Additionally, the length of this light lock compartment is relatively great, so that a corresponding length of photographic strip is wasted.

SUMMARY OF THE INVENTION

It is a general object of the invention to provide a photographic developing apparatus of the general type in question which is, however, inherently more reliable in its operation and furthermore so designed that the length of photographic strip which becomes exposed to light upon infeed into the apparatus is very short.

This object, and others which will become more understandable from the following description of preferred embodiments, can be met, according to one advantageous concept of the invention by utilizing an infeed passage for photographic strips to be processed which extends out from the holding socket for the light-tight cassette and leads the interior of the developing apparatus, the infeed passage being located down-path of the light lock compartment. A movable flap is provided at an opening located between the light lock compartment and the interior of the developing apparatus. In one of its end positions, the flap light-tightly closes off the aforementioned opening. The opening, the flap, and the infeed passage are so positioned relative to one another, that when the leading end of a photographic strip to be processed is pushed into the infeed passage and into the region of the flap, the flap can be moved to its shut position, light-tightly closing off the opening and simultaneously carrying the leading end of the photographic strip into the interior of the light lock compartment.

The creation of a light lock compartment in which the strip clip-on operation can be performed, and which can be light-tightly closed off relative to the exterior or the interior of the developing apparatus, makes it possible to perform the clip-on operation in a very small and narrow space. In this way, the length of photographic strip material which becomes exposed to light during the clip-on operation is kept very small.

The novel features which are considered as characteristic for the invention are set forth in particular in the appended claims. The invention itself, however, both as to its construction and its method of operation, together with additional objects and advantages thereof, will be best understood from the following description of specific embodiment when read in connection with the accompanying drawings.

BRIEF DESCRIPTION OF THE DRAWING

FIG. 5 depicts the clip-on arrangement of FIG. 1 after the completion of the clip-on operation;

FIG. 8 depicts an alternative embodiment of the shutting members for the light lock compartment, with their respective movements being made interdependent in another manner.

DESCRIPTION OF THE PREFERRED EMBODIMENTS

Figure 1:
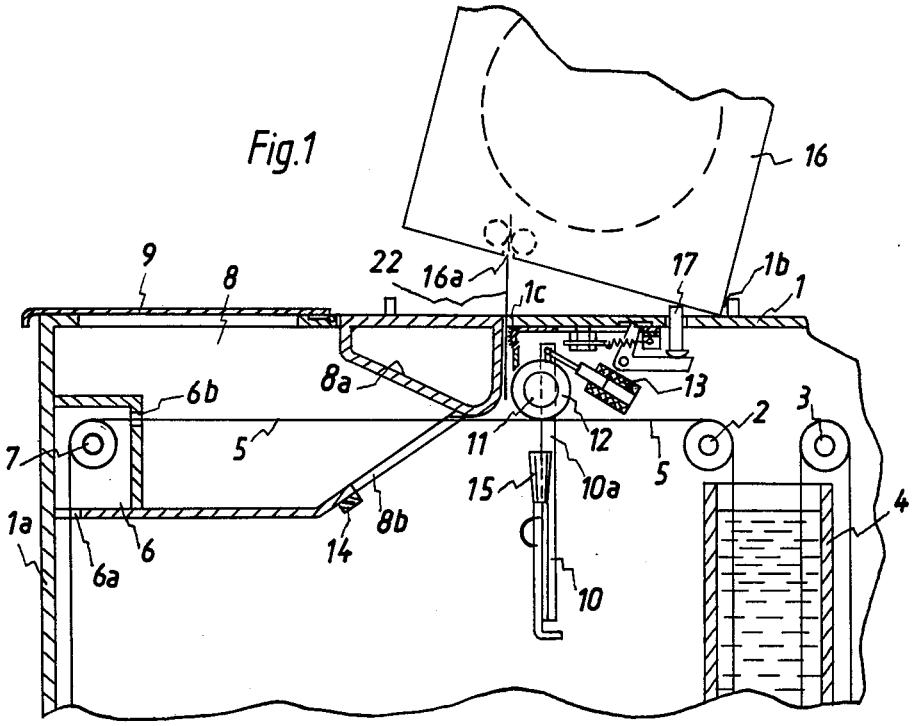
FIG. 1 depicts a portion of a photographic developing apparatus, with the clip-on arrangement in its starting position, and with a cassette being inserted into place.

In FIG. 1, numeral 1 denotes the light-tight housing of a photographic developing machine, of which only a portion is actually depicted. The basic construction of the machine may for example be that disclosed in Federal Republic of Germany Patent No. 1,190,338, FIG. 1. The path to be travelled by the photographic strip to be processed is defined by a plurality of guide rollers 2, 3. The photographic strip travels along this path, deflected about the guide rollers, through successive ones of the processing fluid containers 4. Containers 4 hold the various chemicals required for the processing of the photographic strip material. The guide rollers 2, 3, and the transport components located downstream of such guide rollers, can be positively driven, instead of just passively turned by the transported strip, in order to ensure that the strip tension cannot rise above a certain value.

To facilitate the threading into the developing machine of a photographic strip to be processed, there is provided an endless pull strip 5 which extends along the same path of travel as that followed through the machine by the photographic strip to be processed. However, in contrast to the photographic strip, the pull strip 5 travels from the end of the machine back to the beginning of the machine so as to form an endless loop. The leading end of a photographic strip 22 to be processed is secured to the endless pull strip by means of a releasable clip. One such clip is disclosed in Federal Republic of Germany Patent No. 1,190,338, referred to above.

The return travel of the endless pull strip 5 from the end of the developing machine back to be fed into the beginning of the machine occurs within the dark interior of the developing machine. At the front wall 1*a* of the machine, the endless pull strip 5 is guided vertically upward and passes through a guide slit 6*a* into a light-tight chamber 6 containing a guide roller 7, and then it emerges from chamber 6 through an exit slit 6*b*. Upon emergence from chamber 6, the pull strip 5 passes into a light lock compartment 8. Light lock compartment 8 is delimited by walls disposed essentially perpendicular to one another. However, the light lock compartment 8 narrows in direction of pull strip travel and has at its down-path end somewhat the shape of the gable of a roof. The upper side of the light lock compartment 8 is closed off light-tight by means of a cover 9. The upper side 8*a* of the gable-shaped narrowed portion of the light lock compartment 8 is fixedly mounted on the stationary structure of the developing machine, whereas the lower side of the gable-shaped narrowed portion of the light lock compartment 8 is constituted by an opening 8*b*. Opening 7*c* can be closed off by means of a flap structure 10.

The pull strip 5 travels through the light lock compartment 8 with a generally horizontal orientation at about the middle of the compartment 8 right to the gable of the roof-like narrowed portion of the compartment 8. The flap structure 10 is pivotable about a pivot rod 11 which lies in a plane parallel to the plane of the pull strip 5 and which furthermore extends perpendicular to the direction of pull strip travel. A guide roller 12 is mounted freely rotatable on the pivot rod 11. The portion of the flap structure 10 above its pivot rod 11 is engaged by the armature of a pull-in electromagnet 13. The electromagnet 13 is controlled by a microswitch located in the region of cover 9 in such a manner that, when cover 9 is opened, the electromagnet 13 becomes energized and causes the flap structure 10 to pivot up and close off the opening 8*b*.

The rim of the opening 8*b* is provided with a foam rubber seal 14 to contribute to the sealing off of light from the interior of light lock compartment 8, and to supplement the effect of a per se conventional pneumatic damping mechanism operative for cushioning the impact of the flap structure 10 when the latter moves to its closed position.

The flap structure 10 itself is provided with a slit 10*a* which extends parallel to the pivot rod 11. The pull strip 5 is guided through this slit 10*a*. The flap structure 10 is provided at its upper portion with a brush 15 made up of black bristles. When the flap structure 10 is in its closed position, the brush 15 constitutes an upper edge portion of the flap structure 10. The brush 15, together with the rounded-off end of the surface 8*a* of the air lock compartment wall, form a sealed gap, through which the pull strip 5 can be pulled, without giving rise to wear phenomena such as could result in pull strip deterioration. Travel of the pull strip through the sealed gap formed by brush 15 proceeds smoothly even when the endless pull strip 5 is provided with a connector, for example in the form of a coiled wire.

By having the bristles of brush 15 extend in the travel direction of the pull strip 5, a particularly low-wear guidance of the pull strip can be achieved.

Alongside the cover 9 on the top of the housing 1 of the machine, there is provided a holding socket 1*b* for the accommodation of a light-tight strip cassette 16. The cassette 16 can be of the type disclosed in Federal Republic of Germany Offenlegungsschrift 2,165,499. The cassette 16 is provided at its lower side with an exit slit 16*a* from which projects a certain length of the photographic strip material 22, for example about 15 centimeters. The holding socket 1*b* for the cassette 16 is provided, at a location corresponding to that of the exit slit 16*a* of the cassette 16, with an infeed passage 1*c* which extends approximately tangent to the guide roller 12. Additionally, the cassette holding socket 1*b* is provided with a sensing pin 17 which, when activated by the lower side of a cassette being inserted into socket 1*b*, causes a shutter mechanism for the infeed passage 1*c* to move to open position, as described below.

Figure 6:
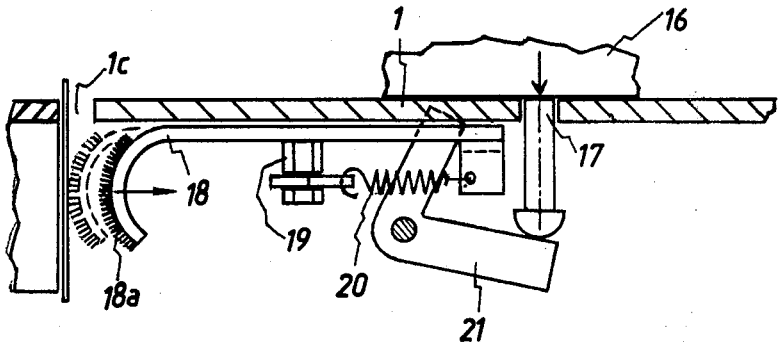
FIG. 6 is a side view of the components utilized to close off the infeed passage.
Figure 7:
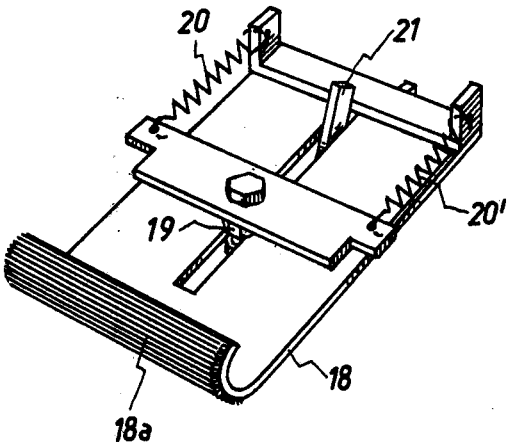
FIG. 7 is a perspective view of the components of FIG. 6.

Details of the shutter mechanism for the infeed passage 1*c* and the operation of the shutter mechanism are depicted in FIGS. 6 and 7. The shutter proper is in the form of a sliding member 18 which due to the provision of a longitudinal slit is slidable along a guide 19 fixedly connected to a stationary portion of the structure of the developing machine. The front end of the sliding member 18, i.e., the end which adjoins the facing boundary wall of the infeed passage 1*c*, is provided with a velvet layer 18*a*. Biasing springs 20, 20' are connected at one end to a stationary portion of the structure and at their other ends to the sliding member 18 itself. Springs 20, 20' urge the sliding member 18 against the opposite wall of the infeed passage 1*c*.

A two-armed lever 21 is mounted on a stationary pivot rod. One arm of lever 21 engages the longitudinal slot in the sliding member 18, whereas the other arm of lever 21 is acted upon by the sensing pin 17. When the cassette 16 is lowered into the holding socket 1*b*, the cassette depresses the pin 17, causing the lever 21 to pull the sliding member 18 and thereby unblock the infeed passage 1*c* so that the leading end of the photographic strip to be processed can feed into passage 1*c* without being contacted.

FIG. 7 shows the use of two biasing strips 20, 20'. The use of such springs ensures that the velvet layer 18*a* is always pressed with uniform pressure across its entire width against the opposite boundary wall of the infeed passage 1*c*, so as to establish a reliable light sealing action.

If the developing machine operates at particularly high speed, then a problem arises when the leading end of a photographic strip 22 to be processed is to be clipped on the pull strip 5. Because of the high travel speed of the pull strip 5, it may be necessary to slow down the pull strip to create sufficient time for the clip-on operation. When this is unacceptable, it is contemplated to make use of a pull strip accumulator to obviate the slowing of the pull strip during the clip-on operation. The per se well known pull strip accumulator is operative during pull strip travel to accumulate a length of pull strip. When a clip-on operation is to be performed, the trailing end of the section of pull strip in the accumulator can be detained at the light lock compartment 8, with the accumulated pull strip length being fed out from the accumulator. In this way, there is adequate time for the clip-on operation, and yet the travel of pull strip 5 and of photographic strip material 22 already clipped thereon through the machine can proceed at normal operating speed. Such a pull strip accumulator is disclosed, for example, in Federal Republic of German Offenlegungsschrift 2,246,313.

The operation of the illustrated clip-on arrangement will be described with reference to FIGS. 1 - 5, which show the different phases of the clip-on operation.

FIG. 1 depicts the starting position of the arrangement. A cassette 16 is just being inserted into the holding socket 1*b*. The leading end of the photographic strip 22 is being fed into the infeed passage 1*c*, passing along the spring-biased yieldable shutter member 18.

Figure 2:
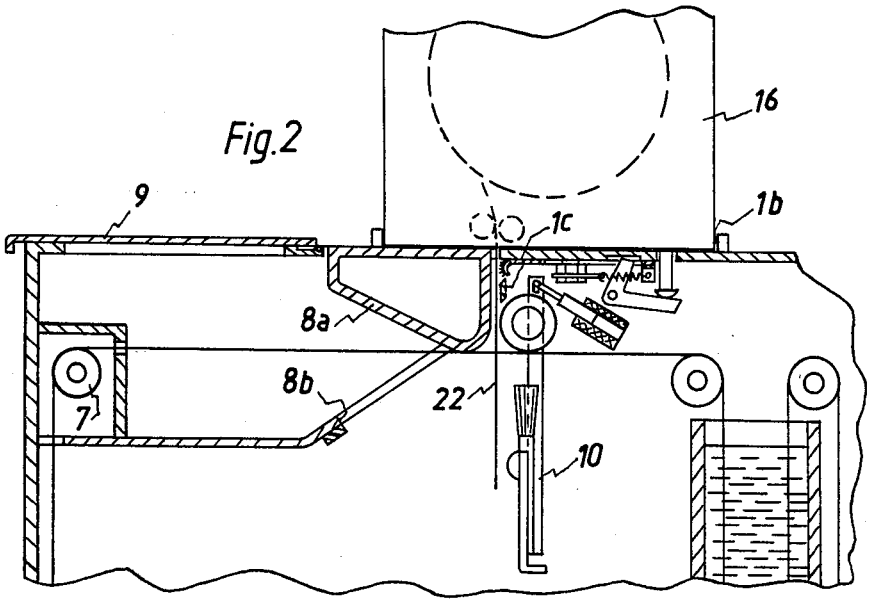
FIG. 2 depicts the apparatus of FIG. 1, with the cassette now inserted into place.
Figure 3:
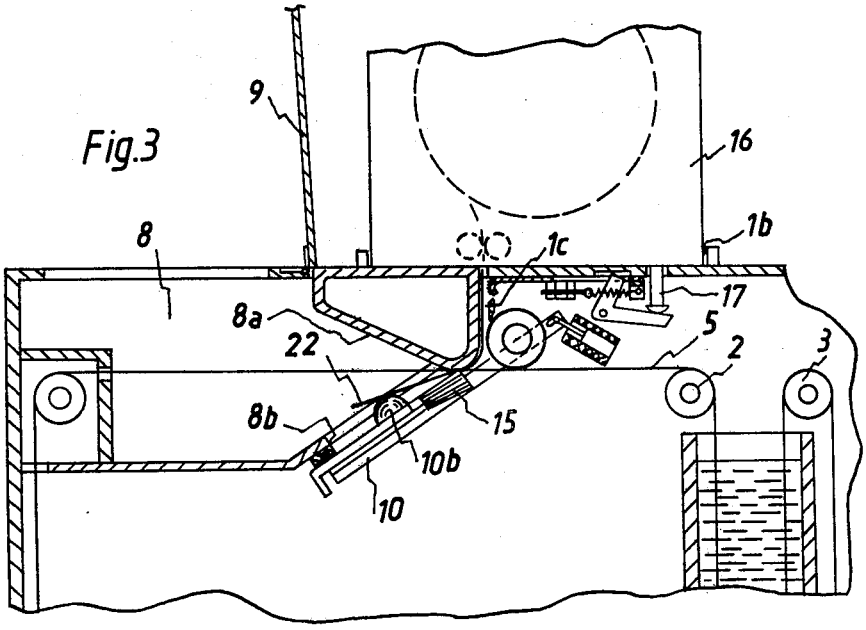
FIG. 3 depicts the apparatus of FIGS. 1 and 2, after the leading end of a photographic strip has been inserted into the light lock compartment.

In FIG. 2, the cassette 16 has been fully inserted into the holding socket 1*b*. The leading end section of copying material 22 fed in through passage 1*c* is located up-path of the flap structure 10, as considered in the direction of travel of pull strip 5. If now the operator of the machine opens up the cover 9, the microswitch responsive to such opening effects energization of the electromagnet 13. As a result, the flap structure 10 pivots upward to the closed position shown in FIG. 3, thereby light-tightly separating off the light lock compartment 8 from the remainder of the interior of the developing machine. When the flap structure 10 thusly moves up into its closed position, it takes the leading end of the photographic strip 22 with it, so that such leading end will project into the now closed light lock compartment 8. The provision of a raised portion 10*b* on the flap structure 10 causes the leading end of strip 22 to be bent up away from the face of flap structure 10, and thereby be more readily engaged by the operator of the machine.

Figure 4:
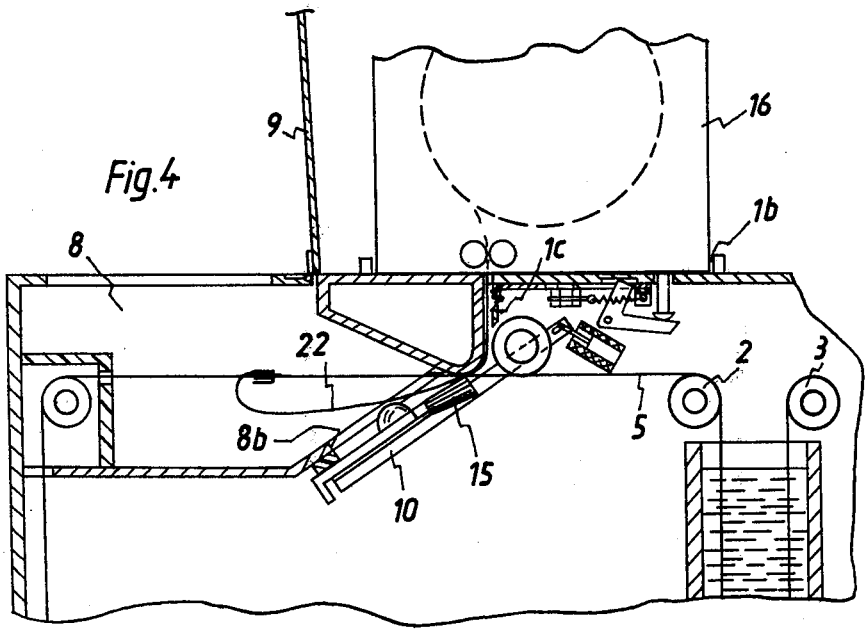
FIG. 4 depicts the clip-on arrangement after the clipping on of the leading end of the photographic strip in the light lock compartment.

FIG. 4 shows the next stage of operation. A clip is attached to the leading end of the photographic strip 22, and then such leading end is clipped onto the pull strip 5. If a pull strip accumulator is used, the portion of the pull strip up-path of the accumulator can be held stationary during the clip-on operation. If no pull strip accumulator is being used because of the low travel speed of the pull strip, then the clip-on operation is performed by the machine operator during the slow travel of the pull strip.

When the clip-on operation has been completed, the operator closes the cover 9. This causes the electromagnet 13 to become deenergized, as a result of which the flap structure 10 returns to the starting position shown in FIG. 1. The travel of the pull strip 5 with the photographic strip 22 secured thereto through the slit 10*a* occurs without physical contact of the rim of the slit 10*a*, the slit 10*a* being of sufficient breadth. It may happen that the operator fails to close the cover 9 at the right time, for example so that the flap structure is still in the closed position shown in FIGS. 3 and 4 as the clip moves past. If this occurs, the resilient and yieldable characteristics of the sealing action afforded by the black-bristle brush 15 ensures that the clip, as well as the two strips 22 and 5, can pass out of the light lock compartment 8 without damaging the brush 15 and without beinging about the entry of light.

The clip-on arrangement shown in the drawing in sectional view can be used in a processing apparatus in which a plurality, in particular four different paths for photographic strip material are arranged side-by-side. In that event, both the cover 9 and the flap structure 10 can extend over the entire width of the developing machine; when a photographic strip is being clipped onto the pull strip in one of the plurality of paths, light will not fall onto the strips in the neighboring paths.

In the event that the flap structure 10 is closed in its closed position, the travel of strips along the adjoining paths will not in any way be impeded, because the slit 10*a* will be so wide as not to contact the adjoining strips and the pull strip will be able to travel through the brush seal 15 without suffering wear.

The opening of the shutter 18 when the cassette 16 is lowered into its holding socket 1*b* does not result in damage to the light-sensitive material, because the infeed passage 1*c* at such time will be covered over by the cassette 16 itself.

When the cassette 16 is being removed, the sequence of operations described above proceeds in reverse. When the cassette 16 is lifted off the socket 1*b*, the sensing pin 17 is released. The biasing springs 20, 20' cause the sliding member 18 to return to its closed position before any amounts of light worth mentioning can pass through the infeed passage 1*c* into the interior of the apparatus.

The clip-on arrangement described above can be advantageously utilized even when the clips for securing the photographic strip 22 to the pull strip 5 are of a form different from that disclosed in Federal Republic of Germany Patent No. 1,190,338, e.g., even if the securing means are not clips at all. It will accordingly be understood that the expression clip-on is intended to cover that attachment expedients besides those involving single clips.

Instead of using a microswitch to coordinate the closing of flap structure 10 with the opening of cover 9, and vice versa, use could be made of a mechanical interconnection expedient such as shown in FIG. 8. Components corresponding to those of FIG. 1 are denoted by the same reference numerals. The flap structure 10 has connected to it an activating lever 23 which is held in one of its two end positions by means of a dead-center spring 25. The cover 9 is locked by means of a rod 24 which is moved by the flap structure 10 from its locking to its released position. A non-illustrated sliding member activated by the cover 9 permits the resetting of lever 23 only when cover 9 is closed. This interengagement assures that when the cover 9 is open the flap structure 10 will be closed, and vice versa.

It will be understood that each of the elements described above, or two or more together, may also find a useful application in other types of constructions differing from the types described above.

While the invention has been illustrated and described as embodied in a single-path photographic developing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an apparatus for processing photographic strips, in combination, a plurality of processing stations; an endless pull strip extending through the successive processing stations; a light lock compartment located in the path of travel of the pull strip and having an open side opening into the interior of the apparatus; a flap structure mounted for movement between a closed position in which the flap structure closes off the open side of the light lock compartment and an opened position; a holding socket on the processing apparatus for holding a light-tight cassette containing photographic strip material to be processed, the holding socket being provided with an infeed passage extending into the interior of the apparatus down-path of the light lock compartment, the flap structure being so positioned relative to the infeed-passage that the path of motion of the flap structure from the opened to the closed positions thereof crosses the path of infeed travel of the leading end of a photographic strip extending through the infeed passage, whereby when the leading end of a strip is being fed through the infeed passage, displacement of the flap structure to closed position both seals off the light lock compartment from the interior of the apparatus and moves such leading end into the light lock compartment so that the leading end can be secured to the endless pull strip.

2. The apparatus defined in claim 1, the opening in the light lock compartment having an upper and a lower side, the endless pull strip leaving the light lock compartment through the opening along the upper side thereof, the flap structure being provided along the upper side of the opening in the light lock compartment with a sealing brush, the bristles of which extend generally in the direction of pull strip travel.

3. The apparatus defined in claim 2, the flap structure being mounted for pivoting movement about a pivot axis lying in a plane parallel to the general plane of the portion of the pull strip in the light lock compartment and furthermore extending perpendicular to the direction of pull strip travel, the flap structure being provided with a slit, the pull strip travelling through the slit, the sealing brush defining the boundary of the slit when the flap structure is in the closed position thereof.

4. The apparatus defined in claim 3, the flap structure being pivotable about a pivot rod coaxial with said pivot axis, the apparatus furthermore including a guide roller mounted freely rotatable on the pivot rod and positioned to deflect photographic strip material through the infeed passage into the travel direction of the pull strip.

5. The apparatus defined in claim 1 the light lock compartment including a movable cover affording access into the interior of the light lock compartment for attaching the leading end of a photographic strip to the pull strip, and means for moving the flap structure to the closed position thereof in automatic response to the opening of the movable cover.

6. The apparatus defined in claim 5, the means for moving the flap structure including a switch responsive to opening of the movable cover, an electromagnet coupled to the flap structure, and means connecting the the switch in the current path of the electromagnet.

7. The apparatus defined in claim 1, the apparatus further including a chamber having an entrance slit and an exit slit and containing a deflection roller, the pull strip extending into the entrance slit, around the deflection roller and emerging from the exit slit into the light lock compartment.

8. The apparatus defined in claim 1, the apparatus further including a shutter for shutting off the infeed passage to prevent entrance of light, and means responsive to the placement of a cassette on the cassette holder for causing the shutter to open the infeed passage.

9. The apparatus defined in claim 8, the shutter having a velvet layer for contacting the photographic strips passing through the infeed passage.

10. The apparatus defined in claim 8, further including means yieldably holding the shutter in closed position so that the shutter can yield in response to travel of photographic strip material through the infeed passage.

* * * * *